United States Patent [19]

Speier

[11] Patent Number: 4,936,265

[45] Date of Patent: Jun. 26, 1990

[54] V-TYPE INTERNAL COMBUSTION ENGINE

[75] Inventor: Wolfgang Speier, Tübingen, Fed. Rep. of Germany

[73] Assignee: Daimler-Benz AG, Fed. Rep. of Germany

[21] Appl. No.: 452,374

[22] Filed: Dec. 19, 1989

[30] Foreign Application Priority Data

Jan. 21, 1989 [DE] Fed. Rep. of Germany ..... 3901721

[51] Int. Cl.[5] ..... F01L 1/34; F01L 1/04; F02B 75/22

[52] U.S. Cl. ..... 123/90.17; 123/90.31; 123/55 VS; 123/55 VE; 474/85

[58] Field of Search ..... 123/90.15, 90.17, 90.27, 123/90.31, 55 VF, 55 VS, 55 VE, 55 V; 474/84, 85

[56] References Cited

U.S. PATENT DOCUMENTS

| | | | |
|---|---|---|---|
| 4,553,473 | 11/1985 | Ichida et al. | 123/90.31 |
| 4,643,143 | 2/1987 | Uchiyama et al. | 123/90.31 |
| 4,716,864 | 1/1988 | Binder | 123/90.31 |
| 4,726,331 | 2/1988 | Oyaizu | 123/90.15 |
| 4,729,348 | 3/1988 | Okada et al. | 123/90.31 |

FOREIGN PATENT DOCUMENTS

| | | | |
|---|---|---|---|
| 0220796 | 5/1987 | European Pat. Off. | 123/90.31 |
| 3534446 | 9/1987 | Fed. Rep. of Germany . | |
| 0232305 | 10/1986 | Japan | 123/90.31 |
| 0012808 | 1/1988 | Japan | 123/90.31 |

OTHER PUBLICATIONS

"Sport Auto" Summer 1986, No. 3, p. 40 (Maserati).

*Primary Examiner*—David A. Okonsky
*Assistant Examiner*—Weilun Lo
*Attorney, Agent, or Firm*—Evenson, Wands, Edwards, Lenahan & McKeown

[57] ABSTRACT

A V-type internal combustion engine having two overhead camshafts per cylinder bank is provided with an absolutely synchronous rotational-angle adjustment between two inlet camshafts and the engine crankshaft to minimize torque fluctuations in the cam drive. One of the two camshafts actuating the inlet valves of the internal combustion engines has a device for the rotational-angle adjustment of this camshaft relative to the crankshaft and the two camshafts actuating the inlet valves are coupled to one another via a timing chain or a toothed belt which is in operative connection between an output side of the rotational-angle adjusting device and the other camshaft actuating the inlet valves.

6 Claims, 2 Drawing Sheets

V-TYPE INTERNAL COMBUSTION ENGINE

BACKGROUND AND SUMMARY OF THE INVENTION

The invention relates to a V-type internal combustion engine having two overhead camshafts per cylinder bank, which are driven from the crankshaft via a timing chain or a toothed belt and which actuate the inlet and outlet valves controlling the charge cycle of the internal combustion engine. The invention relates to a device for adjusting, relative to the engine crankshaft, the rotational-angle adjustment of the two camshafts actuating the inlet valves for an internal combustion engine.

The periodical "Sport Auto", 1986, No. 3, page 40 discloses an internal combustion engine of this general type. In this internal combustion engine, the two inlet and outlet camshafts are driven from the crankshaft via a single toothed belt. To enable a rotational-angle adjustment of the inlet camshafts relative to the crankshaft in this internal combustion engine, a separate camshaft adjuster would have to be arranged on each inlet camshaft. Both of those adjusters would have to be actuated in complete synchronism to enable identical displacement of the inlet valves of both cylinder banks to be realized. However, this would require a relatively complex control system. In addition, there are relatively large torque fluctuations in the cam drive in the case of a belt guide of this type.

It is known from German Offenlegeungsschrift 3,534,446 to couple two camshafts of an internal combustion engine to one another via a belt drive. Provided on this belt drive is a rotational-angle adjusting device with which a synchronous adjustment of the two camshafts relative to the crankshaft is possible. In this publication, however, nothing is stated about the belt guide in a V-type internal combustion engine.

The object of the instant invention is to create an internal combustion engine of the type described above, wherein an absolutely synchronous rotational-angle adjustment between the two inlet camshafts and the crankshaft can be achieved with minimum outlay and in which the torque fluctuations in the cam drive are reduced to a minimum.

The object is achieved according to the invention by having a rotational-angle adjusting device arranged on one of the two camshafts actuating the inlet valves of the internal combustion engine and with the two camshafts actuating the inlet valves coupled to one another via a further timing chain or a further toothed belt. The further timing chain or the further toothed belt provides an operative connection between output side of the rotational-angle adjusting device and the other camshaft actuating the inlet valves.

According to the invention, the inlet camshafts of the two cylinder banks are coupled to one another via a separate timing chain or a separate toothed belt. Here the two camshafts are driven by the timing chain, or the toothed belt, on the output side of a camshaft adjuster arranged on one of the two inlet camshafts. Thus an absolutely synchronous rotational-angle adjustment between the inlet camshafts of the two cylinder banks and the crankshaft can be achieved.

Furthermore, when the belt guide according to the invention is used, only one camshaft adjuster is necessary. By the direct connection between the two inlet camshafts via a separate timing chain, or a separate toothed belt, the fluctuations in the behavior of the cumulative torque of the inlet camshafts are reduced to such an extent that only a restraining torque acts on the camshaft adjuster in the lower speed range. In the case of a hydraulically actuable camshaft adjuster connected to an oil circuit dependent on engine speed, no rattling noises need therefore be expected in the area of the helical gearing of the camshaft adjuster when starting the internal combustion engine (where initially there is no oil pressure) and in the critical lower speed ranges in which the oil pressure is only minimal. These noises occur when a driving and a restraining torques act in constant alternation on the inlet camshafts. However, with the belt guide according to the invention, only restraining camshaft torques occur in these critical lower speed ranges and there is no longer any continual change in contact caused by clearance in the helical gearing of the camshaft adjuster. Rattling noises are thus eliminated. This advantageous behavior of the inlet camshaft torques exists in 8-cylinder internal combustion engines with a V-angle of 90° and four valves per cylinder (two inlet and two outlet valves).

Other objects, advantages and novel features of the present invention will become apparent from the following detailed description of the invention when considered in conjunction with the accompanying drawings.

DETAILED DESCRIPTION OF THE DRAWINGS

Figure 1:
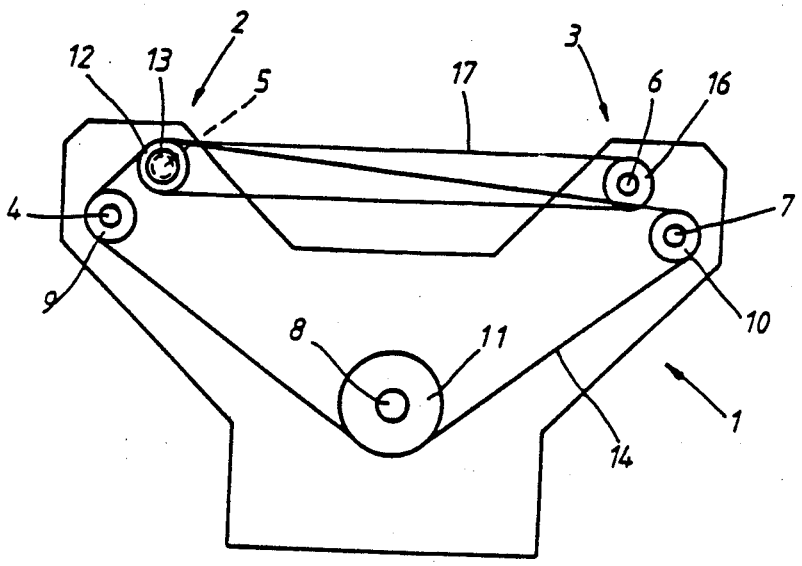
FIG. 1 shows an internal combustion engine according to the invention in diagrammatic representation.
Figure 2:
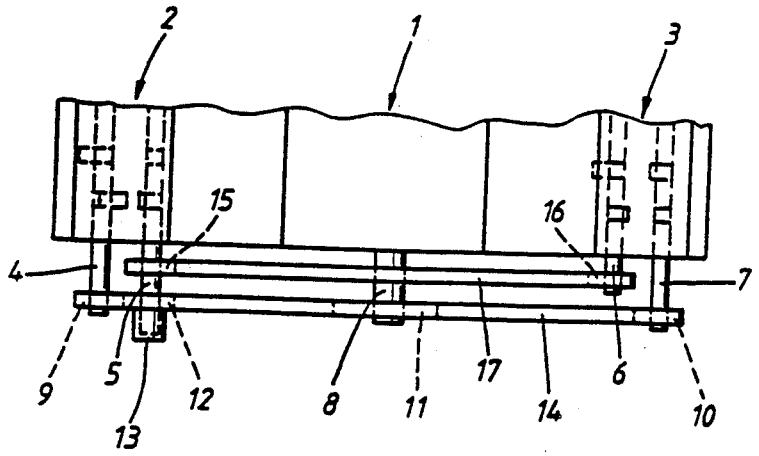
FIG. 2 shows a plan view of FIG. 1.

FIG. 1 shows, in a schematic front view, an 8-cylinder, V-type internal combustion engine 1 which has a V-angle of 90°. Each cylinder bank 2 and 3 has two overhead camshafts 4, 5 and 6, 7 respectively, of which two are inlet camshafts 5 and 6 to actuate inlet valves of the engine (not shown) and two are outlet camshafts 4 and 7 to actuate the outlet valves of the engine (also not shown). To control the charge cycle, the internal combustion engine 1 has two inlet and two outlet valves per cylinder. The two outlet camshafts 4 and 7 and the crankshafts 8 of the internal combustion engine 1 are each connected to belt pulleys 9, 10, and 11 in such a way as to be fixed in terms of rotation. The inlet camshaft 5, on the other hand, can be driven via a belt pulley 12, which is part of an adjustable timing device (camshaft adjuster 13) which can be acted upon by the lubricating oil of the internal combustion engine 1 for varying the rotational-angle adjustment between the crankshaft 8 and the camshaft 5 (camshaft adjuster 13). As apparent from FIG. 2, the belt pulleys 9, 10, 11 and 12 lie in one plane, and a first toothed belt 14 is looped around them. Any desired rotational-angle adjustment between the crankshaft 8 and the inlet camshaft 5 can thus, as a first adjustment, be realized via this toothed belt 14 and the camshaft adjuster 13, the construction of which will not be dealt with in detail here.

On the output side of this camshaft adjuster 13, the inlet camshaft 5 is connected to a belt pulley 15 in such a way as to be fixed in terms of rotation. Arranged in the same plane as the belt pulley 15 is a belt pulley 16, provided on the second inlet camshaft 6 and connected to the latter in such a way as to be fixed in terms of rotation. A further toothed belt 17 is laid around the two belt pulleys 15 and 16.

If rotational-angle adjustment between the crankshaft 8 and the inlet camshaft 5 is now effected by actuation of the camshaft adjuster 13, the inlet camshaft 6, on account of the connection between the two inlet camshafts 5 and 6 via the toothed belt 17, automatically undergoes the same adjustment relative to the crankshaft 8 as the camshaft 5.

Figure 3:
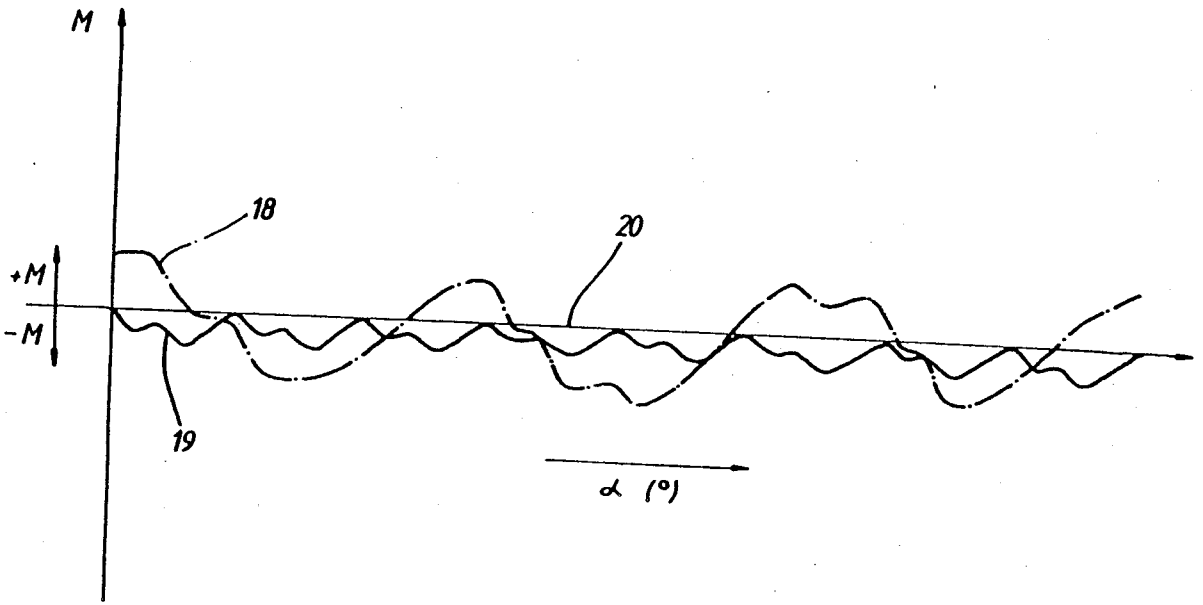
FIG. 3 shows the behavior of the camshaft torque in a conventional internal combustion engine compared with that in an internal combustion engine according to the invention.

FIG. 3, shows in an $M=f(\alpha)$ diagram, the behavior of the torque M acting on the inlet camshafts 5 and 6 or on the camshaft adjuster 13 as a function of the cam angle at an internal combustion engine speed of 1500 rev/min for a conventional internal combustion engine (function 18 shown by chain-dotted line) and for an internal combustion engine according to the invention (function 19 shown by solid line). A positive driving torque acts on the respective inlet camshaft in the area above the abscissa 20 (+M), and a negative restraining torque acts in the area below the abscissa 20 (−M).

The function 18 for a conventional internal combustion engine clearly shows the continual, undesirable alternation between a driving (+M) and a restraining torque (−M). On the other hand, owing to the direct coupling between the two inlet camshafts 5 and 6 on the output side of the camshaft adjuster 13, according to the invention only a restraining torque (−M) (function 19) acts on these inlet camshafts 5 and 6. The alternation between driving and restraining torque in low speed ranges, which is disadvantageous for a camshaft adjuster which can be acted upon by the lubricating oil, thus no longer exists.

The camshaft adjuster 13 can also be arranged on the inlet camshaft 6.

In a further development of the invention, the toothed belt 14 can also be laid around the belt pulleys 9, 16, 10 and 11. The camshaft adjuster 13 can, in this embodiment as well, be arranged either on the camshaft 5 or on the camshaft 6.

The two outlet camshafts 4 and 7 and the inlet camshaft 5 (FIGS. 1 and 2) need not necessarily be driven via a single toothed belt. It is likewise conceivable to drive the above-mentioned camshafts via separate toothed belts.

The drive can also be effected via timing chains instead of via toothed belts.

The invention is not exclusively restricted solely to 8-cylinder internal combustion engines with a V-angle of 90°. It can also be used in 6-cylinder internal combustion engines with a V-angle of 60° or 90°.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A V-type internal combustion engine having two overhead camshafts for each of its two cylinder banks;

all said camshafts being driven from an engine crankshaft via at least one of a timing chain and a toothed belt means;

each cylinder bank having one of its camshafts for actuating inlet valves and the other for actuating outlet valves to control a charge cycle of the internal combustion engine;

an adjustment means for adjusting an angle of two camshafts actuating the inlet valves of the internal combustion engine relative to the crankshaft;

wherein adjustment means is arranged on one of the two camshafts actuating the inlet valves of the internal combustion engine;

wherein the two camshafts actuating the inlet valves are coupled to one another via at least one of a further timing chain and a further toothed belt means; and wherein the at least one further timing chain and further toothed belt is in operative drive connection between an output side of the angle adjusting means and the other camshaft actuating the inlet valves.

2. Internal combustion engine according to claim 1, wherein the two camshafts actuating the outlet valves and one of the two camshafts actuating the inlet valves are driven via a single said at least one timing chain and a single toothed belt means.

3. Internal combustion engine according to claim 1, wherein the internal combustion engine has 8 cylinders and a V-angle of approximately 90°.

4. Internal combustion engine according to claim 2, wherein the internal combustion engine has 8 cylinders and a V-angle of approximately 90°.

5. Internal combustion engine according to claim 1, wherein the internal combustion engine has 6 cylinders and a V-angle of approximately 60° or 90°.

6. Internal combustion engine according to claim 2, wherein the internal combustion engine has 6 cylinders and a V-angle of approximately 60° or 90°.

* * * * *